US006979766B2

(12) United States Patent
Goto

(10) Patent No.: US 6,979,766 B2
(45) Date of Patent: Dec. 27, 2005

(54) STRINGED INSTRUMENT NECK PART VARIABLE DEFORMATION CORRECTING DEVICE

(75) Inventor: Masao Goto, Isesaki (JP)

(73) Assignee: Gotoh Gut Co., Ltd., Isesaki (JP)

( * ) Notice: Subject to any disclaimer, the term of this patent is extended or adjusted under 35 U.S.C. 154(b) by 75 days.

(21) Appl. No.: 10/476,890

(22) PCT Filed: May 14, 2001

(86) PCT No.: PCT/JP01/03992

§ 371 (c)(1),
(2), (4) Date: Nov. 14, 2003

(87) PCT Pub. No.: WO02/093545

PCT Pub. Date: Nov. 21, 2002

(65) Prior Publication Data

US 2004/0129126 A1 Jul. 8, 2004

(51) Int. Cl.[7] ..... G10D 3/00
(52) U.S. Cl. ..... 84/293; 84/267
(58) Field of Search ..... 84/293, 267

(56) References Cited

U.S. PATENT DOCUMENTS 2,510,775 A * 6/1950 Forcillo ..... 84/293
5,465,642 A 11/1995 Goto

FOREIGN PATENT DOCUMENTS

JP 57-41825 9/1982
JP 2736860 8/1995

* cited by examiner

*Primary Examiner*—David Martin
*Assistant Examiner*—Jianchun Qin
(74) *Attorney, Agent, or Firm*—Armstrong, Kratz, Quintos, Hanson & Brooks, LLP

(57) ABSTRACT

A distortion correcting device is accommodated at a concave portion of the neck of a stringed instrument, and includes a bar including a bottom plate portion and a pair of opposing side plate portions erected at both sides of the bottom plate portion; and an adjusting rod whose one end portion is secured to one end portion of the bar and whose other end portion engages with an adjusting nut which is rotatably supported by the other end portion of the bar, and in which the distance between the one end portion of the adjusting rod and the adjusting nut can be changed by turning the adjusting nut. A first support member and a second support member are secured to the side plate portions at both end portions of the bar, and one end portion of the adjusting rod is supported such that movement in an axial direction is blocked by the first support member, and the adjusting nut is rotatably supported by the second support member.

5 Claims, 5 Drawing Sheets

STRINGED INSTRUMENT NECK PART VARIABLE DEFORMATION CORRECTING DEVICE

BACKGROUND OF THE INVENTION

1. Field of the Invention

The present invention relates to a distortion correcting device for use at the neck of a stringed instrument such as a guitar, and more particularly, to a distortion correcting device in which the downward bow when the neck is distorted so as to be concave with respect to the strings and the upward bow when the neck is distorted so as to be convex with respect to the strings, is corrected.

2. Description of the Related Art

In a stringed instrument such as a guitar, strings are wound between a bridge mounted on the body, and a tuner mounted on the head which is at the front end of the neck. As a result, if the stringed instrument is stored with the strings being tensioned, the neck may distort into a concave configuration. When the neck bows downward, the length of the string is increased and playing of the instrument becomes difficult, and also when a string is depressed, the string tension is increased, thus causing the fret to be out of tune. In the past, various distortion correcting devices for correcting the downward bow of the neck have been proposed. For example, Japanese Utility Model Application Laid-Open No. 62-146195 discloses a distortion correcting device which includes an adjusting rod disposed inside a bar whose central portion has a U-shaped cross section, and the bar is nipped between one end portion of the adjusting rod which extends from the bar and an adjusting nut which screws together with the other end portion of the adjusting rod at the other end portion side of the bar. In this type of distortion correcting device, a closed space is accommodated between the groove and the finger plate formed in the neck. Also, when the neck bows downward, by the adjusting nut being tightened, the bar bends in the direction for upward bowing, and the downward bow in the neck is thereby corrected.

Also, there are guitars in which the neck is formed beforehand so as to have an upward bow and thus has a slightly convex portion, and when the strings are tensioned, the neck is distorted as a result of the string tension and the strings become parallel to the neck. As a result, the upward bow of the neck may become larger as a result of the quality of the seasoning of the material used for forming the neck, or as a result of changes in the environment subsequent to the manufacturing of the guitar. Thus, distortion of the convex configuration may still remain after the string has been tensioned. This distortion is an upward bow, and when this upward bow is formed, the string which is pressed during performance contacts the fret causing chattering and making performance impossible.

In the distortion correcting device disclosed by the applicant of the present invention in Japanese Patent No. 2,736,860, the downward bow and the upward bow of the neck can be corrected. In this distortion correcting device, one end portion of an adjusting rod is secured to a bottom portion of one end of a bar having a U-shaped cross-section, and an adjusting nut, which is screwed together with the other end portion of the adjusting rod, is rotatably supported by the other end portion of the bar. In this distortion correcting device, when the adjusting nut is tightened, the secured ends of the adjusting nut and the adjusting rod approach each other, and the bar bends back in the direction opposite to that of the downward bow of the neck. As a result, the downward bow of the neck is corrected. In addition, if the adjusting nut is turned in the direction for slackening, the distance between the secured ends of the adjusting nut and the adjusting rod is increased, and the bar bends back in the direction opposite to that of the upward bow of the neck, and as a result, the upward bow of the neck is corrected.

It should be noted that in Japanese Patent No. 2,736,860, a pressing element is provided at the adjusting rod so as to be positioned at the center of the distortion of the neck, and the distortion of the neck is effectively corrected by the bar being pressed by the pressing element.

However, in the above-described distortion correcting device, despite the fact that the pressing element is being used, when the bar is caused to bend back, it is difficult for the bar to achieve a suitable curvature, and it has become apparent that at the front end portion which secures the adjusting rod, the bar is not sufficiently bent back. In addition, there are some guitars in which the adjusting nut is accommodated at the head, and some in which the adjusting nut is accommodated at the base portion of the body side of the neck, and the type which is used is different depending on the guitar manufacturer or the type of guitar. In particular, in the guitar in which the adjusting nut is accommodated at the base portion of the neck, in order to ensure that the neck is sufficiently hard, the bar is sometimes not extended to the front end portion of the neck, and in this case, it is difficult for the correction of the distortion of the front end portion of the neck to be suitably carried out, and this problem needs to be solved.

An object of the present invention is to provide a distortion correcting device in which the curve of the bar is suitable after distortion is corrected, and the correction of the distortion can be accurately carried out.

A distortion correcting device for a neck of a stringed instrument, of the present invention comprises a bar accommodated at a concave portion of the neck, the bar having a bottom plate portion and a pair of opposing side plate portions erected from both sides of the bottom plate portion, an adjusting rod whose one end portion is secured to one end portion of the bar and whose other end portion engages with an adjusting nut which is rotatably supported at the other end portion of the bar, a first support member and a second support member which are secured to the side plate portions at both end portions of the bar, wherein the distance between the one end portion of the adjusting rod and the adjusting nut can be changed by turning the adjusting nut, and one end portion of the adjusting rod is supported such that movement in an axial direction is blocked by the first support member, and the adjusting nut is rotatably supported by the second support member.

In the distortion correcting device for the neck of a stringed instrument (simply referred to as "distortion correcting device" hereinafter), by turning the adjusting nuts, the distance between a first and second support member is changed, and the side plate portion which is secured by first and second support members extends or contracts in the longitudinal direction. On the other hand, because the length of the bottom plate portion does not change, a bend moment is generated at both end portions of the bottom plate portion by the length of the side plate portion being changed. The entire bars, including the bottom plate portion, is bent back by this bend moment. In this case, the bend moment which is generated at both end portions of the bottom plate portion acts on the support end portions of the adjusting rod and the adjusting nut which are at both the first and second support members. As a result, the size of bend moment of both is approximately the same. Accordingly, the bottom plate portion can be bent substantially uniformly and the distortion can be accurately corrected.

The side plate portions of the first and second support members are closely fitted into each other and may be fixed by being welded. However, if the first and second support members are fixed only by the welding the strength by which they are secured together and this is insufficient, it is thus preferable that the first and second support members be provided with convex portions which closely fitted into a concave portion formed in the side plate portions. Also, it is preferable that the concave portion and the convex portion be welded in a state in which they are fit into each other. In addition, the first support member is engaged in an axial direction with a peripheral edge groove formed in an outer periphery of one end portion of the adjusting rod, and the second support member is engaged in an axial direction with a peripheral edge groove formed in an outer periphery of the adjusting nut. Thus, the adjusting rod and the adjusting nut are firmly supported by the first support member and the second support member. Furthermore, the distances of the concave portions from the bottom plate portion are approximately equal, and thus the bend moment which acts on the respective end portions of the adjusting rod is approximately equal.

In the present invention, the adjusting nut is turned and caused to move relative to the adjusting rod, and thus it is necessary for the adjusting rod to be secured so that it does not rotate. In this case, the adjusting rod may be welded to the first supporting tool; however, by applying the structure described in the following, anti-rotation can be simplified and can be carried out at a low cost.

That is to say, at the front end surface of the adjusting rod, an anti-rotation concave portion which has a non-circular cross-section is provided, and the bottom plate portion is bent with respect to the front end edge of the bottom plate portion, thereby providing an anti-rotation plate portion which is equipped with a concave anti-rotation portion into which the convex anti-rotation portion fits. The cross section of the convex anti-rotation portion may have any suitably selected configuration, as long as it is not circular, and these include that of a circle having one or both sides cut out, or a polygonal configuration. In addition, because the anti-rotation plate portion is bent by sheet metal working, if the bottom plate portion and the side plate portion of the bar is formed integrally by a metal sheet being subjected to sheet metal working, the manufacturing cost is further reduced.

By carrying out anti-rotation in the manner described above without welding the adjusting rod to the first support member, the adjusting rod is movable in the direction which is perpendicular to the axial direction by the amount of the space between the convex anti-rotation portion and the convex anti-rotation portion. This is very important in order for the direction in which the bar is bent back to be secured and for the bending of the bar to be uniform. That is to say, when the adjusting rod is welded to the first support member, the center of the adjusting rod is sometimes mispositioned with respect to the center of the adjusting nut, due to error in manufacturing, or error in assembling or the like. If the adjusting nut is turned in this state, the bend moment acts on the adjusting rod, and this bend moment in turn acts on the bar.

Thus, it is not desirable for the front end portion of the adjusting rod to be firmly fixed by welding and the like, and it is desirable that a space be provided such that the adjusting rod is movable with respect to the bar in the direction which is perpendicular to the axial direction thereof. This space is suitably provided at both sides in the direction in which the adjusting rod moves toward or separates from the bottom plate portion (vertical direction) so as have sizes of 0.2 to 0.4 mm respectively, and to have sizes of 0.1 to 0.3 mm respectively in the direction which crosses that direction (lateral direction). The space which allows and also restricts movement of the adjusting rod in the above-mentioned direction is provided between the anti-rotation concave portion and the anti-rotation convex portion, and between the adjusting rod and the first support member and members, such as the bottom plate portion of the bar.

DETAILED DESCRIPTION OF THE PREFERRED EMBODIMENT

Figures 1A, 1B, 1C:
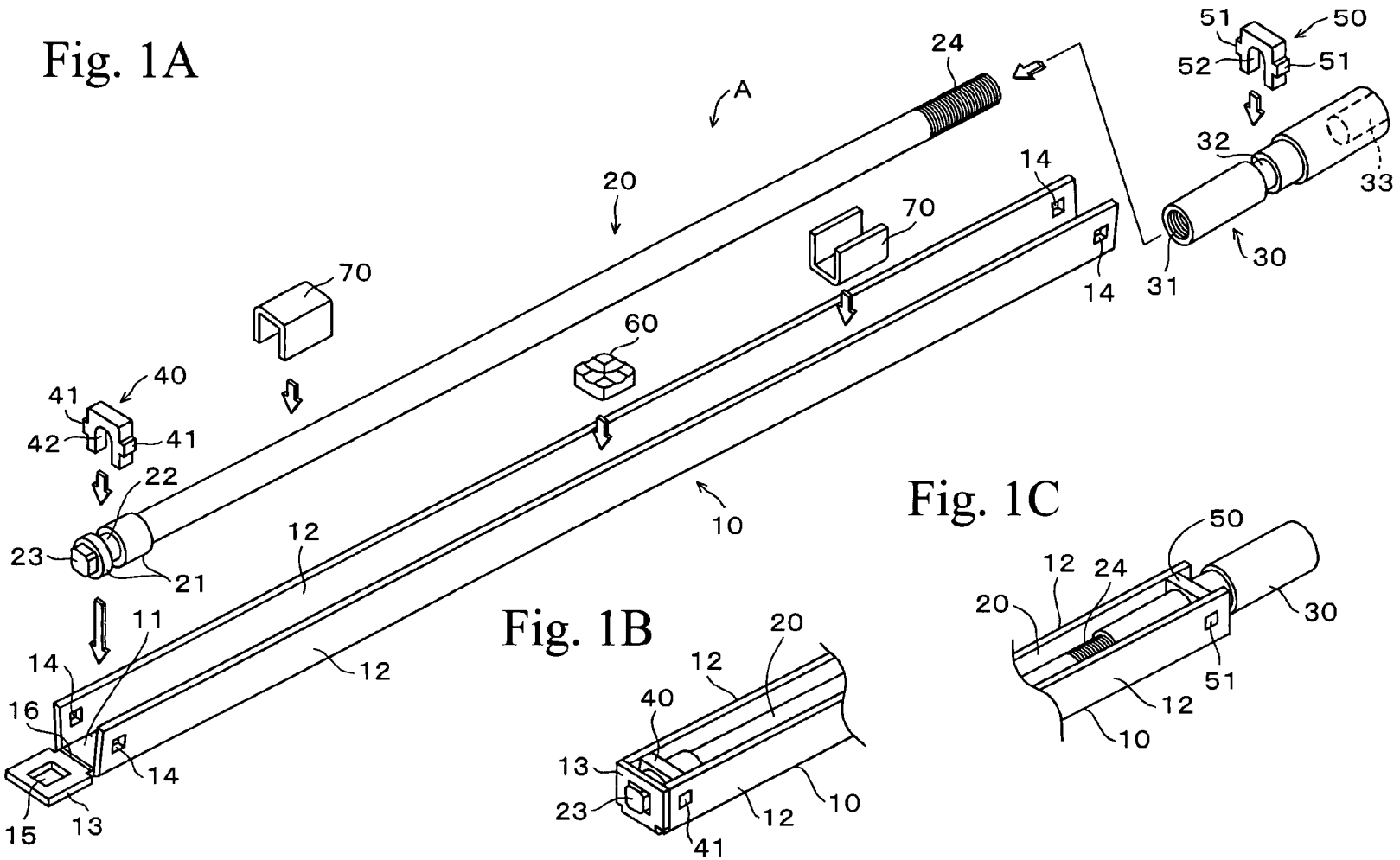
FIG. 1 is an assembly perspective view of the distortion correcting device of an embodiment of the present invention.

The following is a description of the embodiment of the present invention with reference to FIGS. 1 to 5. It should be noted that in the following description, the left side of the FIG. 1 is considered the top end side, and this direction is taken as a reference when expressions such as "longitudinal direction" and "lateral direction" are used.

FIG. 1 is an assembly perspective view of the distortion correcting device A of the embodiment of the present invention. In the figures, reference numeral 10 is the bar. The bar 10 comprises: the bottom plate portion 11; the side plates 12 which are erected at both sides of the bottom plate portion 11 so as to be perpendicular with respect thereto; and the anti-rotation plate portion 13 which is erected at the edge of the front end of base plate portion so as to be perpendicular with respect thereto.

Concave portions 14 which are rectangular in shape are provided so as to penetrate the side plate portion 12 at both ends thereof. The distance of each of the concave portions 14 from the bottom plate portion 11 is secured. It should be noted that the concave portion 14 may also be circular. Also, a concave anti-rotation portion 15 which is rectangular in shape is provided so as to penetrate the center of the anti-rotation plate portion 13. A thin joint 16 is formed by press molding at the border of the anti-rotation plate portion 13 and the bottom plate portion 11, and the anti-rotation plate portion 13 can be easily folded along the joint 16.

In the figures, reference numeral 20 is the adjusting bar. The adjusting bar 20 is a steel rod which has a circular cross section, and at the front end portion thereof, two large diameter portions 21 having a larger diameter than the back end portions, are formed, and between these two large diameter portion, a peripheral edge groove portion is formed. At the front end face of the adjusting bar 20, a convex anti-rotation portion 23 having a rectangular cross-section is formed. This convex anti-rotation portion 23 engages with the concave anti-rotation portion 15 leaving a predetermined space between the two. Also, a screw 24 is formed in the outer periphery of the back end portion of the adjusting screw 20, and the screw 24 is screwed together with the adjusting nut 30.

At the front end portion of the adjusting nut 30, a female screw 31 which screws together with the screw 24, is formed. Also, at the back end portion of the adjusting nut 30, a wrench hole 33 having, for example, a hexagonal cross-section is formed. At the middle portion of the adjusting nut 30 in the axial direction thereof (in the middle of the female screw 31 and the wrench hole 33), a peripheral edge groove 32, whose diameter is smaller than that of the other portions, is formed.

The first support member 40 and the second support member 50 are engaged with the peripheral edge portions 22 and 32 of the adjusting bar 20 and the adjusting nut 30, respectively. The first support member 40 is U-shaped, and at both side faces thereof, convex portions 41 which extend laterally are formed. This convex portion 41 closely fitted with the concave portion 14 which is formed in the side plate portion 12 of the bar 10. In addition, the inner peripheral face 42 of the first support member 40 is U-shaped and the space between the inner peripheral face 42 and the inner face which faces the inner peripheral face 42 is slightly larger than the distance across from the adjusting rod 20 to the peripheral edge portion 22. Also, the curve radius of the arc-shaped inner face is set so as to be slightly larger than the outer diameter (radius) of the peripheral edge portion 22. It should be noted that the second support member 50 has the same shape and same size as the first support member 40, and includes the convex portion 51 and the inner peripheral face 52. In the first and second support members 40 and 50 having the structure described above, the convex portions 41 and 51 are closely fitted with the concave portion 14, and these portions are fixed by being welded.

Figure 4A:
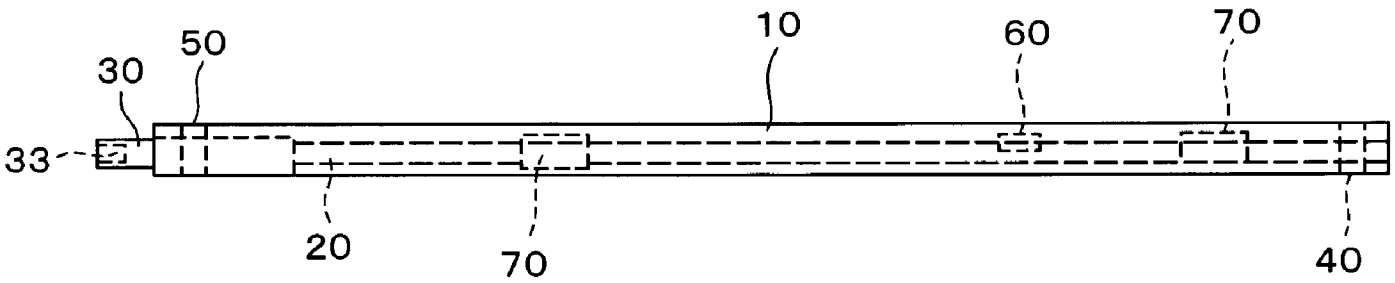
FIG. 4A is side view of the distortion correcting device of the embodiment.
Figure 4B:
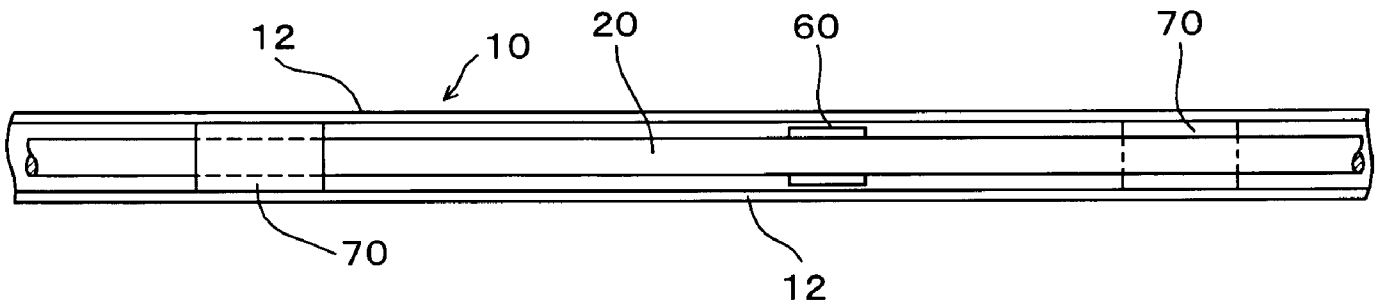
FIG. 4B is bottom surface view thereof.

In FIG. 1, reference numeral 60 is a pressing element, and when the pressing element 60 is turned in the tightening direction of the adjusting nut 30 and the adjusting rod 20 shortens, the bottom plate portion of the bar 10 is effectively pressed and then bent back. In addition, reference numeral 70 is a block, and the block 70 prevents the side plate 12 from deforming when the bar 10 bends backs. FIG. 4A is side view of the distortion correcting device of the embodiment, and FIG. 4B is bottom surface view thereof.

Figure 2:
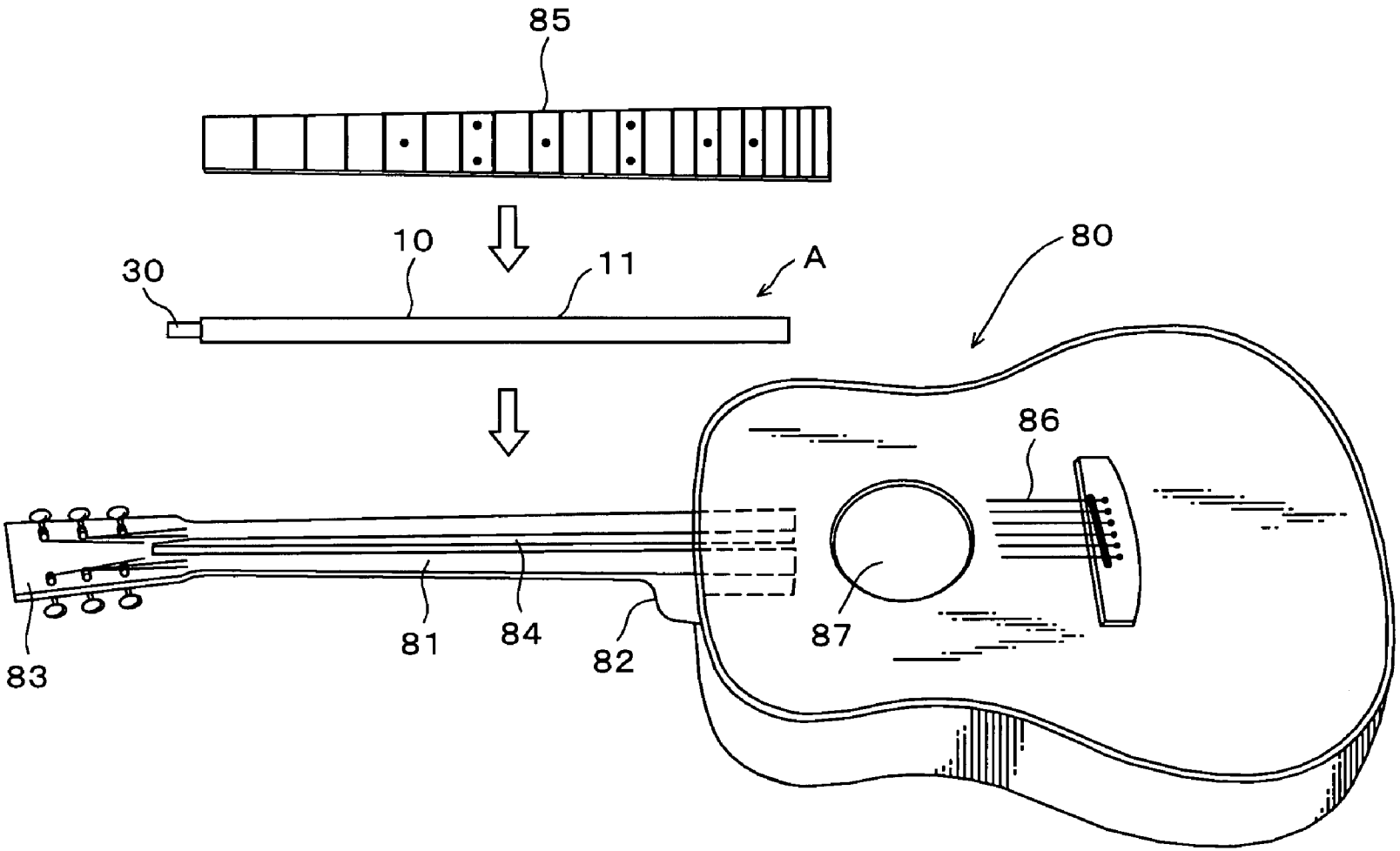
FIG. 2 is a perspective view of a guitar for installing the distortion correcting device of the embodiment of the present invention.
Figure 3:
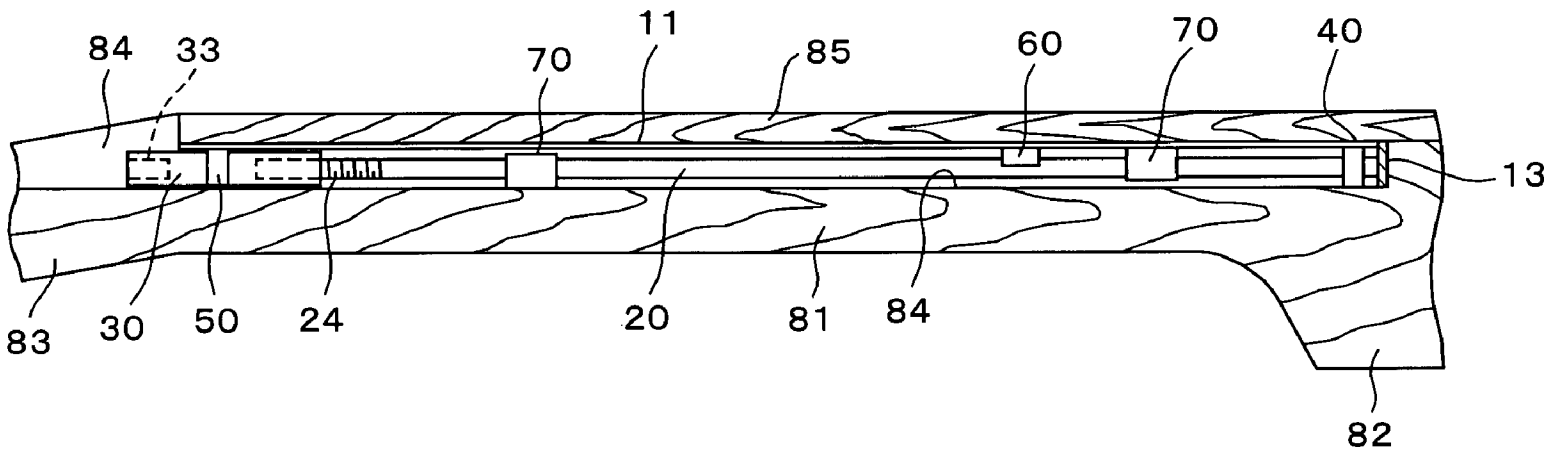
FIG. 3 is a side sectional view of the neck of the guitar.

Next, FIGS. 2 and 3 show a distortion correcting device A having the structure described above and a guitar in which is installed this distortion correcting device. In the drawings, reference numeral 80 is the body and reference numeral 81 is the neck. At the center of the surface of the neck 81, the groove 84 which extends from the base portion 82 to the head 83 is formed. Also, the distortion correcting device A is accommodated in a state in which the adjusting nut 30 contacts the head 83 and the bottom plate portion 11 is in the direction toward the neck 81, and the finger plate 85 is attached to the surface of neck 81, and the distortion correcting device A is thereby mounted. It should be noted that in FIG. 2, reference numeral 86 represents the guitar strings.

Figure 5A:
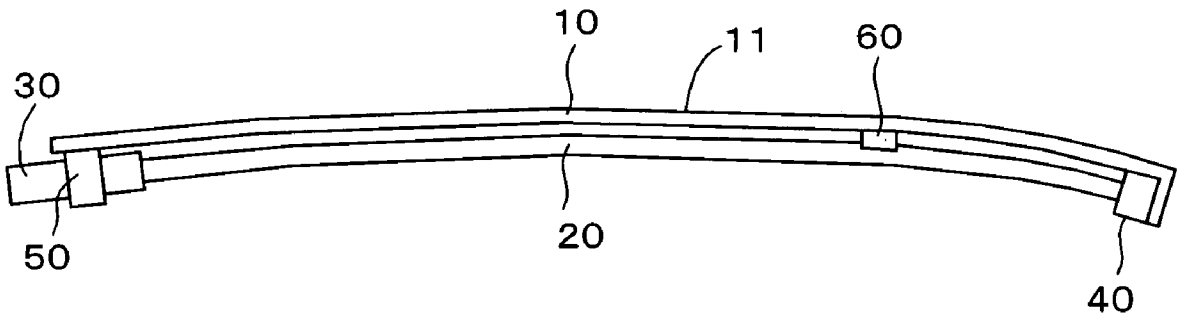
FIG. 5A is a side sectional view of the distortion correcting device showing a state in which a concave distortion of the neck is corrected.

Next, the application of the distortion correcting device having the above structure will be described. First, the correction process for downward bow generated in the case where the neck 81 has concave distortion caused by tensioning of the string 86 will be described. In the guitar neck 81 described above, as can be seen from FIG. 3 which shows the neck in detail, the adjusting nut 30 extends to the head 83 portion of the groove 84. A wrench is inserted into the wrench hole 33 and the adjusting nut 30 is twisted in the direction for tightening. As a result, the adjusting nut 30 is moved relative to the base plate 82 side of the neck 81 along the screw 24 of the adjusting rod 20. Thus, because the length along the adjusting rod 20 between the first and second support members 40 and 50 is shorter than the length along the bar 10, as shown in FIG. 5, and the distortion correcting device causes the first and second support members 40 and 50 to bend back in the upward direction to form a convexity along with the bar 10. At this time, the pressing element 60 is pressed onto the bottom plate portion 11 of the bar 10, and therefore the bending back of the bar 10 can be ensured. Also, because the distortion correcting device A which is restricted by the groove 84 and the finger plate 85 of the neck causes bending back in the upward direction so as to form a convexity, and the downward bow which was generated at the neck is corrected.

Figure 5B:
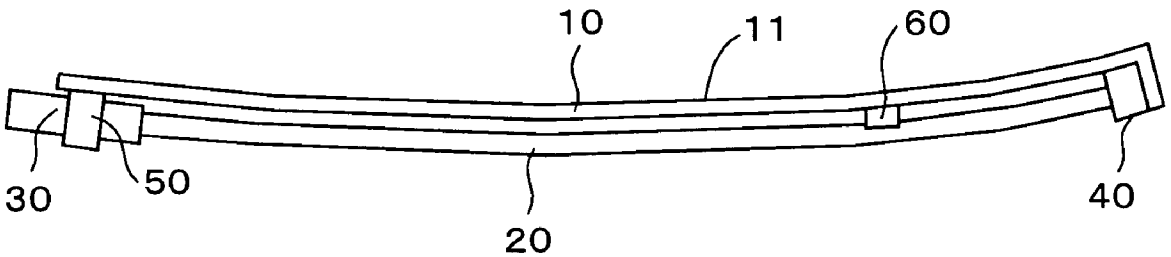
FIG. 5B is a side sectional view of the distortion correcting device showing a state in which a convex distortion of the neck is corrected.

Next, in the case where an upward bow is generated by concave distortion of the neck 81, the nut 30 is twisted in the direction for loosening which is opposite to the direction for tightening in which it was turned above. Thus, the adjusting nut 30 is moved relative to the head 83 side along the screw 24 of the adjusting rod 20. Therefore, because the length of the adjusting rod 20, which is between the first and second support members 40 and 50, is longer than the length along the bar 10, as shown in FIG. 5B, the distortion correcting device A bends back the first and second support members 40 and 50 along with the bar 10 in the downward direction to form a concavity. Also, because the distortion correcting device is bent back in a concave configuration, the neck 81 having an upward bow is corrected.

In the distortion correcting device A having the structure described above, the distance between the first support members 40 and 50 changes by the adjusting nut 30 being turned. As a result, the side plate 12 extends or shortens in the longitudinal direction. Therefore, the bend moment acts upon both end portions of the bottom plate portion 11, and the bottom plate portion is bent backward due to this bend moment. In this case, because the bend moment generated at the both end portions of the act on portions of the support members 40 and 50 which support the adjustment rod 20 and the adjustment nut 30, the size of the bend moment is substantially equal. As a result, the curve of the bottom plate portion 11 is imparted in a substantially uniform manner, and correction of the distortion is thereby carried out.

In particular, in the embodiment described above, the concave portion 14 formed in the side plate portion 12 closely fitted together with the convex portions 41 and 51 formed in the first and second support members 40 and 50, and as a result of stress in the axial direction, the first and second support members 40 and 50 never separate from the side plate portion 12. Furthermore, the concave portion 14 and the convex portions 41 and 51 are welded together, and thus, when compression stress acts in the axial direction, outward opening of the side plates 12 is controlled.

Also, in this embodiment, the first support member 40 is engaged in the axial direction with the peripheral edge groove 22 of the adjusting rod 20, and the second support member 50 is engaged in the axial direction with the peripheral edge groove 32 of the adjusting nut 30. Therefore, the adjusting rod 20 and the adjusting nut 30 are firmly supported by the first and second support members 40 and 50. Furthermore, the distance between the bottom plate portion 11 and the concave portions 14 at both end portions of the adjustment rod from each other is approximately equal, and thus the bend moment which acts on the respective end portions of the adjusting rod 20 is approximately equal, and the curvature of the bar 10 can be made even more uniform.

Furthermore, in this embodiment, at the front end face of the adjusting rod 20, an anti-rotation concave portion 23 which has a non-circular cross-section is provided, and an anti-rotation plate portion 13 with a concave anti-rotation portion 15 is provided at the top end edge of the bottom plate portion. Thus, by the anti-rotation bottom plate portion 13 being simply bent, anti-rotation of the adjusting rod 20 is carried out. In addition, because the anti-rotation plate bending working of the portion 13 can be carried out at the same time as the bending working of the side plate portion 12, the manufacturing cost is further reduced.

In addition, in this embodiment space is provided between the anti-rotation convex portion 23 and the peripheral edge groove 22, and between the concave anti-rotation portion 15 and the inner peripheral face of the first support member 40, and thus the adjustment rod is movable in the axial direction as well as in the direction perpendicular thereto. As a result, when the adjusting nut 30 is turned and stress is applied to the adjusting rod 20, the centers of both the adjusting nut 30 and the adjusting rod 20 are automatically aligned, and stress is prevented from being unintentionally generated. Thus, the curvature of the bar can be made even more uniform.

It should be noted that, in this embodiment, the anti-rotation plate portion 13 folds with respect to the bottom plate portion 11, but they may be formed separately and secured together by welding or some other means. Also, flat surfaces which are parallel to each other are formed in the peripheral edge groove 22 of the adjusting rod 20, and anti-rotation is achieved by the inner peripheral face 42 of the first support member 40 being nipped in between these flat surfaces. In that case, the positioning of the adjusting rod 20 in the vertical direction may be carried out by the distance away from the large diameter portion 21 being set, or by shaving the lower surface of the large diameter portion. In addition, the adjusting nut 30 is disposed at the head 83 side, but opposite to the present embodiment, the adjusting nut 30 may be disposed at the base portion 82 side of the neck 81, and the adjusting nut 30 may be turned by inserting a wrench in the sound hole 87 formed in the body.

What is claimed is:

1. A distortion correcting device for a neck of a stringed instrument comprising:

a bar accommodated at a concave portion of the neck, the bar having a bottom plate portion and a pair of opposing side plate portions erected from both sides of the bottom plate portion;

an adjusting rod whose one end portion is secured to one end portion of the bar and whose other end portion engages with an adjusting nut which is rotatably supported at the other end portion of the bar; and a first support member and a second support member which are secured to the side plate portions at both end portions of the bar, wherein the distance between the one end portion of the adjusting rod and the adjusting nut can be changed by turning the adjusting nut, and one end portion of the adjusting rod is supported such that movement in an axial direction is blocked by the first support member, and the adjusting nut is rotatably supported by the second support member, and wherein the first support member is engaged in an axial direction with a peripheral edge groove formed in an outer periphery of one end portion of the adjusting rod, and the second support member is engaged in an axial direction with a peripheral edge groove formed in an outer periphery of the adjusting nut.

2. The distortion correcting device of claim 1, wherein the first and second support members include convex portions for closely fitting with concave portions formed in the side plate portions.

3. The distortion correcting device of claim 2, wherein the distances of the concave portions from the bottom plate portion are approximately equal.

4. A distortion correcting device for a neck of a stringed instrument comprising:

a bar accommodated at a concave portion of the neck, the bar having a bottom plate portion and a pair of opposing side plate portions erected from both sides of the bottom plate portion;

an adjusting rod whose one end portion is secured to one end portion of the bar and whose other end portion engages with an adjusting nut which is rotatably supported at the other end portion of the bar; and a first support member and a second support member which are secured to the side plate portions at both end portions of the bar, wherein the distance between the one end portion of the adjusting rod and the adjusting nut can be changed by turning the adjusting nut, and one end portion of the adjusting rod is supported such that movement in an axial direction is blocked by the first support member, and the adjusting nut is rotatably supported by the second support member, and wherein the front end portion of the adjustment rod includes a convex anti-rotation portion having a non-circular cross section, and the bottom plate portion and the side plate portions of the bar are formed integrally by sheet metal working on a metal sheet, and an anti-rotation plate portion having a concave anti-rotation portion which is closely fitted with the convex anti-rotation portion by being folded with respect to the bottom plate portion is provided at a front end edge of the bottom plate portion.

5. The distortion correcting device of claim 4, wherein a clearance for allowing movement of the adjusting rod in a direction perpendicular to an axial direction of the adjusting rod is provided between the concave anti-rotation portion and the convex anti-rotation portion, and between the first support member and the adjustment rod and the bottom plate portion.

* * * * *